US007673374B2

(12) United States Patent
Hösel

(10) Patent No.: US 7,673,374 B2
(45) Date of Patent: Mar. 9, 2010

(54) APPARATUS AT A SPINNING ROOM MACHINE, ESPECIALLY A FLAT CARD, ROLLER CARD, CLEANER OR THE LIKE, FOR DRAWING A CLOTHING ONTO A ROLLER

(75) Inventor: Fritz Hösel, Mönchengladbach (DE)

(73) Assignee: FA. Truetzschler GmbH & Co. KG, Moenchengladbach (DE)

( * ) Notice: Subject to any disclaimer, the term of this patent is extended or adjusted under 35 U.S.C. 154(b) by 1150 days.

(21) Appl. No.: 11/271,852

(22) Filed: Nov. 14, 2005

(65) Prior Publication Data

US 2006/0143905 A1 Jul. 6, 2006

(30) Foreign Application Priority Data

Nov. 16, 2004 (DE) ..... 10 2004 055 310

(51) Int. Cl.
*D01G 15/84* (2006.01)

(52) U.S. Cl. ..... 19/114; 19/98

(58) Field of Classification Search ..... 19/65 R, 19/98–114

See application file for complete search history.

(56) References Cited

U.S. PATENT DOCUMENTS

2002/0152583 A1* 10/2002 Bischofberger et al. ..... 19/98

FOREIGN PATENT DOCUMENTS

| | | | |
|---|---|---|---|
| DE | 240 569 | A1 | 11/1986 |
| DE | 43 19 631 | C2 | 12/1994 |
| DE | 100 61 286 | C1 | 4/2002 |
| DE | 102 49 001 | A1 | 4/2004 |
| EP | 1 215 312 | A1 | 6/2002 |
| FR | 2 816 331 | | 6/2002 |
| GB | 2 410 506 | A | 8/2005 |
| JP | 55103318 | A | 8/1980 |
| WO | WO 02/46505 | A1 | 6/2002 |
| WO | WO2004/035886 | A2 | 4/2004 |

OTHER PUBLICATIONS

Preliminary Search Report dated May 21, 2008, directed to counterpart FR 05 11602 application.
Written Opinion dated May 21, 2008, directed to counterpart FR 05 11602 application.

* cited by examiner

*Primary Examiner*—Shaun R Hurley
*Assistant Examiner*—Andrew W Sutton
(74) *Attorney, Agent, or Firm*—Venable LLP; Robert Kinberg; Justine A. Gozzi

(57) ABSTRACT

In an apparatus at a spinning room machine, especially a flat card, roller card, cleaner or the like, for drawing a clothing onto a roller using a drawing-on device, the spinning room machine has an electronic control and regulation device. In order to provide an apparatus that is simple in terms of equipment and that makes possible checking of the drawing-on procedure and/or of the measurement data, a measurement device for registering data ascertained during drawing-on is associated with the drawing-on device, and the measurement device co-operates with the electronic control and regulation device of the spinning room machine for permitting passage of data between the drawing-on device and the control and regulation device.

22 Claims, 5 Drawing Sheets

APPARATUS AT A SPINNING ROOM MACHINE, ESPECIALLY A FLAT CARD, ROLLER CARD, CLEANER OR THE LIKE, FOR DRAWING A CLOTHING ONTO A ROLLER

CROSS REFERENCE TO RELATED APPLICATION

This application claims priority from German Patent Application No. 10 2004 055 310.6 dated Nov. 16, 2004, the entire disclosure of which is incorporated herein by reference.

BACKGROUND OF THE INVENTION

The invention relates to an apparatus at a spinning room machine, especially a flat card, roller card, cleaner or the like, for drawing a clothing onto a roller.

In the textile industry sector, especially in the carding sector, it is necessary for the clothings of the working apparatus, for example of a cylinder, to be replaced from time to time. The clothings are parts that are subject to wear.

In a known apparatus (DD 240 569 A1), there is provided a drive system for flat cards or roller cards having at least one speed-controlled three-phase current motor, with which there is associated a speed control device. The speed of rotation of each three-phase current motor can be controlled using a frequency converter, which can in turn be controlled, via a D/A converter, by a micro-computer. Stored in the RAM memory thereof are speed control program blocks for all-steel clothing drawing-on procedures. In the all-steel clothing drawing-on procedure, one of the speed-controlled three-phase current motors is arranged to be in mechanical drive connection with the licker-in, cylinder and/or doffer. In that arrangement, in accordance with the stored program and the speed program blocks stored in the RAM, the CPU in question, timed by means of a CTC, controls the output of actuation pulses to the frequency converters and, consequently, the speeds of the three-phase current motors, in accordance with operational requirements, during drawing-on of the all-steel clothing. The speed control program blocks for all-steel clothing drawing-on procedures serve exclusively for the purpose of controlling the speed of the three-phase current motors. Ascertaining data during the drawing-on of the clothings is dealt with under operator control. A disadvantage, amongst others, in the case of that apparatus is that checking of the drawing-on procedure is not removable as can be necessary, for example, in the event of changes in loading.

It is an aim of the invention, in contrast, to provide an apparatus of the kind mentioned at the beginning that avoids or mitigates the mentioned disadvantages, that especially is simple in terms of equipment, and that makes possible checking of the drawing-on procedure and/or of the measurement data.

SUMMARY OF THE INVENTION

The invention provides a drawing-on apparatus for drawing a clothing onto a roller of a spinning room machine having an electronic control and regulation device, the drawing-on apparatus comprising a measuring device for measurement of data relating to drawing-on, wherein the measuring device is arranged to co-operate, in use, with the control and regulation device of the spinning room machine for permitting passage of data between the drawing-on device and the control and regulation device.

In accordance with the invention, provision can be made for the control and regulation device of the spinning room machine to be used for checking—especially by visualisation and documentation—of the current drawing-on procedure. As a result, correcting the drawing-on procedure is advantageously made possible, especially by means of the operating and display device of the spinning room machine. The ascertained data of the drawing-on procedure are available at all times where they are needed, that is to say directly at the spinning room machine, and without additional devices. When a clothing management means is installed in the control system of the carding machine, the ascertained data represent an optimum addition for the user insofar as a large number of individual drawing-on procedures are registered. The fact that the internal computer of the spinning room machine is used constitutes a very substantial simplification in terms of equipment and, in addition, advantageously allows linkage with internal data of the machine.

A display device for showing the data is advantageously connected to the electronic control and regulation device. Advantageously, the electronic control and regulation device comprises a storage device for storing the ascertained data. Advantageously, the device ascertaining the drawing-on data can communicate directly with the machine in which the roller is being clothed. Advantageously, the data ascertained during the drawing-on procedure are transferred to the spinning room machine, for example a flat card, are stored therein and can be shown at any time on the operating and display device of the machine. Advantageously, the control system of the machine in which the roller is being clothed assumes functions—especially those of operation and display—of the device ascertaining the drawing-on data. Advantageously, the communication between the machine and the device ascertaining the drawing-on data is effected by cable-based means. Advantageously, the communication between the machine and the device ascertaining the drawing-on data is effected without cables. Advantageously, the communication is effected by radio. Advantageously the communication is effected using infra-red light. Advantageously, the communication is effected using visible light. Advantageously, the interface in the spinning room machine, for example a flat card, is used for the communication with other apparatus and/or devices of the spinning room machine and/or spinning room systems. Advantageously, the communication with other apparatus and/or devices is effected by cable-based means. Advantageously, the communication with other apparatus and/or devices is effected without cables. Advantageously, the drawing-on device comprises a roller drive unit having a drive motor. Advantageously, the drawing-on device comprises a braking device acting on the clothing for producing winding-on pretensioning in the region of the clothing between the roller and braking device. Advantageously, the electronic control and regulation device comprises a micro-computer. Advantageously, the measurement device communicates with the electronic control and regulation device. Advantageously, the display device for showing (visualising) the data is connected to the electronic control and regulation device. Advantageously, a visual display device is provided. Advantageously, the storage device for storage of the data is connected to the electronic control and regulation device. Advantageously, a playback device for showing the data is connected to the electronic control and regulation device. Advantageously, the measurement device ascertaining the drawing-on data communicates directly with the spinning machine in which the roller is being clothed. Advantageously, the data ascertained during the drawing-on procedure are transferred to the electronic control and regulation device, are stored therein and can be re-shown on the operating and display device of the spinning room machine. Advantageously, the control system of the machine in which the roller is being clothed assumes functions of the measurement device ascertaining the drawing-on data. Advantageously, the functions comprise operation and/or display. Advantageously, the communication between the spinning room machine and the measurement device ascertaining the drawing-on data is effected without cables (without wires). Advantageously, during the drawing-on procedure, the electronic control and regulation device assumes the display and operating functions and/or the current supply to the measurement device ascertaining the drawing-on data. Advantageously, the interface in the spinning room machine is also used for communication with further devices, for example machines, systems or the like and/or networks of the spinning room. Advantageously, the data ascertained during drawing-on are arranged to be compared and/or linked with machine-relevant data of the spinning room machine. Advantageously, the data include one or more of: the drawing-on force; the drawing-on speed; the temperature of the braking elements; the length of clothing drawn on; the braking force.

Advantageously, the drawing-on procedure can be logged. Advantageously, the data and/or measurement log can be printed out. Advantageously, the drawing-on tension is recorded. Advantageously, any stretching that may be present is recorded. Advantageously, the braking device comprises a braking force sensor. Advantageously, the braking device comprises a speed sensor. Advantageously, the roller drive unit is integrated into the control and regulation circuit of the control and/or regulation unit, and the roller drive unit is arranged to be controlled and/or regulated for automatic matching to the predetermined winding-on tensioning. Advantageously, the roller is the cylinder of a flat card. Advantageously, the roller is the doffer of a flat card. Advantageously, the display and/or storage device is integrated into the electronic machine control and regulation device. Advantageously, the operating device of the spinning room machine is used for operation of the display and/or playback device. Advantageously, the display device of the spinning room machine is used. Advantageously, before, during and after drawing-on, the user receives instructions, messages, information and the like by way of the display device. Advantageously, for the clothing process, for the drive motor in question, a set of parameters optimising the function of the motor is loaded into the corresponding drive control system. Advantageously, the braking device is integrated into the control and/or regulation device, by means of which the braking action can be automatically matched to the winding-on pretensioning. Advantageously, with the spinning room machine there is associated an operating and display device which has a visual display unit and/or a touch-screen and/or a keyboard.

The invention also provides an apparatus at a spinning room machine, especially a flat card, roller card, cleaner or the like, for drawing a clothing onto a roller using a drawing-on device, the spinning room machine having an electronic control and regulation device, wherein an ascertaining device for the measurement of data ascertained during drawing-on is associated with the drawing-on device, and the ascertaining device co-operates with the electronic control and regulation device of the spinning room machine, the ascertaining device and the control and regulation device being capable of exchanging data unidirectionally and/or bidirectionally.

BRIEF DESCRIPTION OF THE DRAWINGS

Certain illustrative embodiments of the invention will be described hereinafter in greater detail with reference to the accompanying drawings, in which.

DETAILED DESCRIPTION OF PREFERRED EMBODIMENTS

Figure 1:
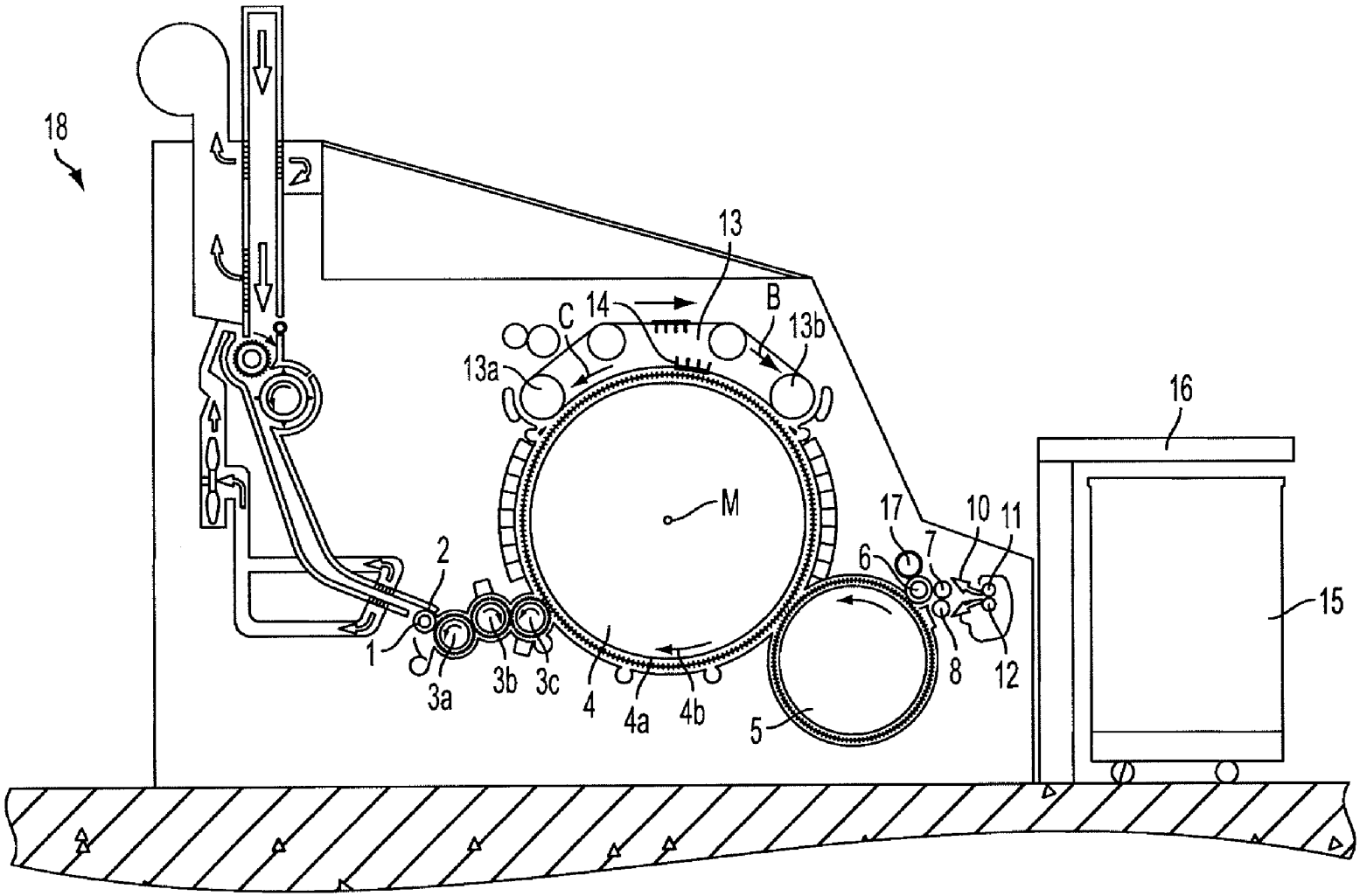
FIG. 1 is a diagrammatic side view of a flat card for use with an apparatus according to the invention.

With reference to FIG. 1, a flat card, for example a TC 03 (trademark) flat card made by Trutzschler GmbH & Co. KG of Monchengladbach, Germany, has a feed roller 1, feed table 2, lickers-in 3*a*, 3*b*, 3*c*, cylinder 4, doffer 5, stripper roller 6, nip rollers 7, 8, web-guiding element 10, draw-off rollers 11, 12, revolving card top 13 having card-top-deflecting rollers 13*a*, 13*b* and card top bars 14, can 15 and can coiler 16. Curved arrows denote the directions of rotation of the rollers. Reference letter M denotes the centre (axis) of the cylinder 4. Reference numeral 4*a* denotes the clothing and reference numeral 4*b* denotes the direction of rotation of the cylinder 4. Reference letter C denotes the direction of rotation of the revolving card top 13 at the carding location and reference letter B denotes the direction in which the card top bars 14 are moved on the reverse side. Reference numeral 17 denotes a cleaning roller for the stripper roller 6 and reference numeral 18 denotes a card feeder.

Figure 2:
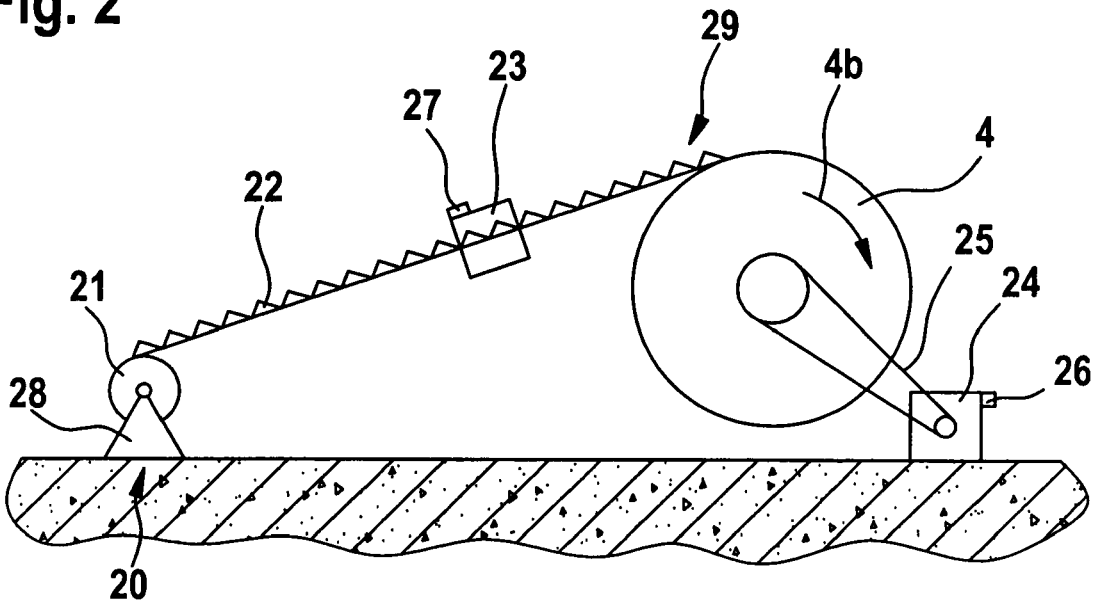
FIG. 2 is a diagrammatic side view of a first arrangement of winding-on and winding-off apparatus.

The drawing-on apparatus shown in FIG. 2 substantially comprises a holding station 20 for a supply bobbin 21, on which a carding clothing 22 in the form of sawtooth wire is flatly wound, and also a braking device 23 and a roller 4. The roller 4 is driven in the clockwise direction 4*b* by means of a motor 24 and a transmission device 25. The motor 24 has a control and regulation device 26, by which the speed of the roller 4 and the direction of rotation can be controlled. The braking device 23 comprises a control and regulation device 27, which brings about a particular braking action. The control and regulation device 26 and the control and regulation device 27 are in operative connection with one another. In a further arrangement, they may also be used as a unit for controlling both the braking device 23 and the motor 24. The carding clothing 22 is wound off from the supply bobbin 21, which is arranged on a mounting block 28, and is then passed through the braking device 23 and wound onto the outer circumference of the roller 4. Following the winding-on procedure, the carding clothing 22 then extends in a helical configuration on the outer circumference of the roller 4. The braking device 23, in co-operation with the roller 4 and, in this instance, particularly by means of the roller drive (the motor 24), is intended to provide pretensioning in the region 29 of the carding clothing 22. This pretensioning ensures that the carding clothing 22 is uniformly and lastingly wound-on or drawn-on.

Figure 3:
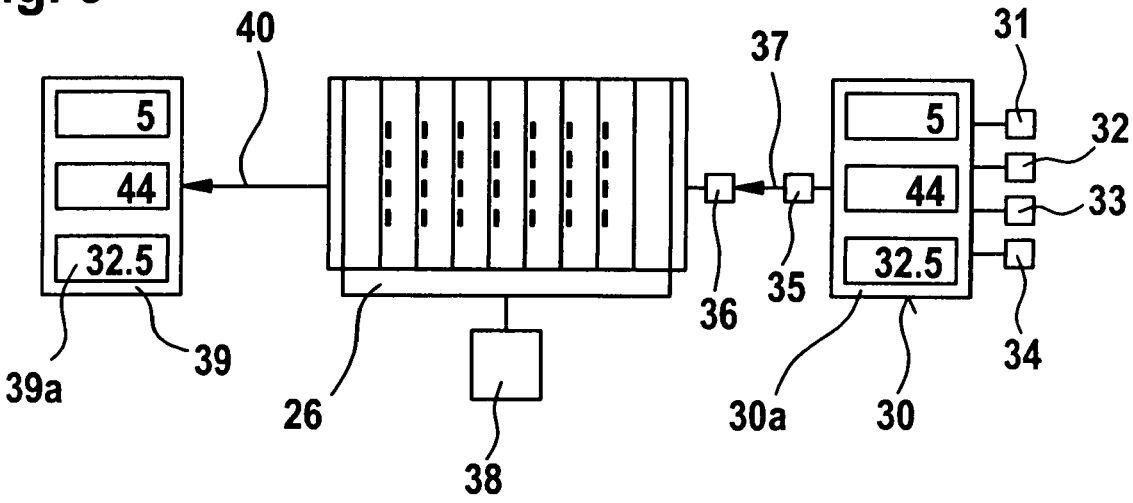
FIG. 3 shows a block circuit diagram comprising sensors, a transfer device for measurement data, an electronic machine control and regulation device and an operating and display device, wherein the data ascertained during drawing-on are transferred unidirectionally and by wire-based means.

The embodiment of FIG. 3, there is provided an ascertaining and registering device 30 for the data ascertained during drawing-on of the clothing 22, to which device there are connected a sensor 31 for the drawing-on force, a sensor 32 for the drawing-on speed, a sensor 33 for total meters (length) and a sensor 34 for temperature. In the case of the embodying example according to FIG. 3 (and the example shown in FIG. 4), the ascertaining and registering device 30 comprises a display device 30*a*. Connected to the ascertaining or registering device 30 is a transmitter 35 for wire-based data transfer. Also provided is an electronic control and regulation device 26, for example a TMS 2 device made by Trützschler GmbH & Co. KG, to which a receiver 36 for wire-based data transmission is connected. The transmitter 35 and the receiver 36 are connected to one another by a unidirectional cable 37. The arrow (cable 37) indicates the transfer direction. The electronic control and regulation device 26 also comprises a data memory 38 for storage of the data ascertained during drawing-on. Connected to the electronic control and regulation device 26, by way of a unidirectional cable 40, is an operating and display device 39.

Figure 4:
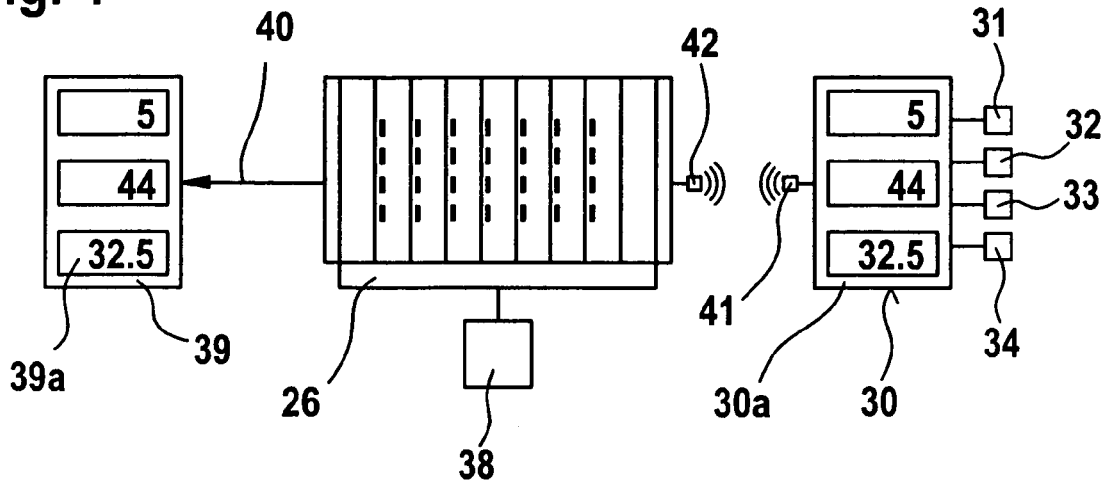
FIG. 4 shows a block circuit diagram which corresponds in many respects to FIG. 3, but wherein the data ascertained during drawing-on are transferred unidirectionally and without wires.

The embodiment of FIG. 4 corresponds substantially to that of FIG. 3, although wireless data transmission is carried out between the ascertaining and registering device 30 and the electronic control and regulation device 26. For the purpose, a transmitter 41 is connected to the ascertaining and registering device 30 and a receiver 42 is connected to the control and regulation device 26, in each case for wireless data transfer.

Figure 5:
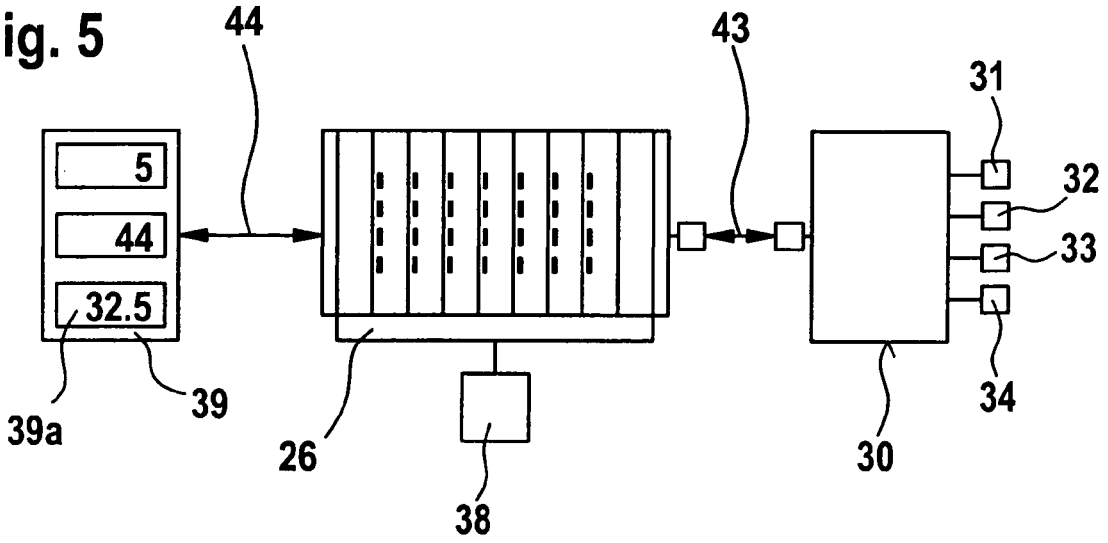
FIG. 5 shows a block circuit diagram for an apparatus according to the invention, wherein the machine control and regulation device during the drawing-on procedure assumes the display and/or operating functions and/or the current supply to the unit ascertaining the drawing-on data.

In the embodiment of FIG. 5, wire-based data transfer is provided between the control and regulation device 26, the ascertaining and registering device 30 and the operating and display device 39, the control and regulation device 26 being connected to the ascertaining and registering device 30 and to the operating and display device 35, in each case, by a bidirectional cable 43 and 44, respectively, allowing data exchange in two directions. The data exchange directions are indicated by the double-headed arrows (see cables 43, 44). Instead of a bidirectional cable 43 and 44, there can also be provided, in each case, two unidirectional cables (not shown), in which the data are transferred in different and opposite directions. The arrangement according to FIG. 5 is especially suitable when the control and regulation device 26 of, for example, the carding machine assumes certain functions or tasks of the drawing-on device, for example the current supply to the drawing-on device.

Indicated on the display devices 30*a* and 39*a* shown in FIGS. 3 to 5 are, by way of example, a drawing-on force of 5 dN, a drawing-on speed of 44 m/min and a temperature of 32.5° C.

Figure 6:
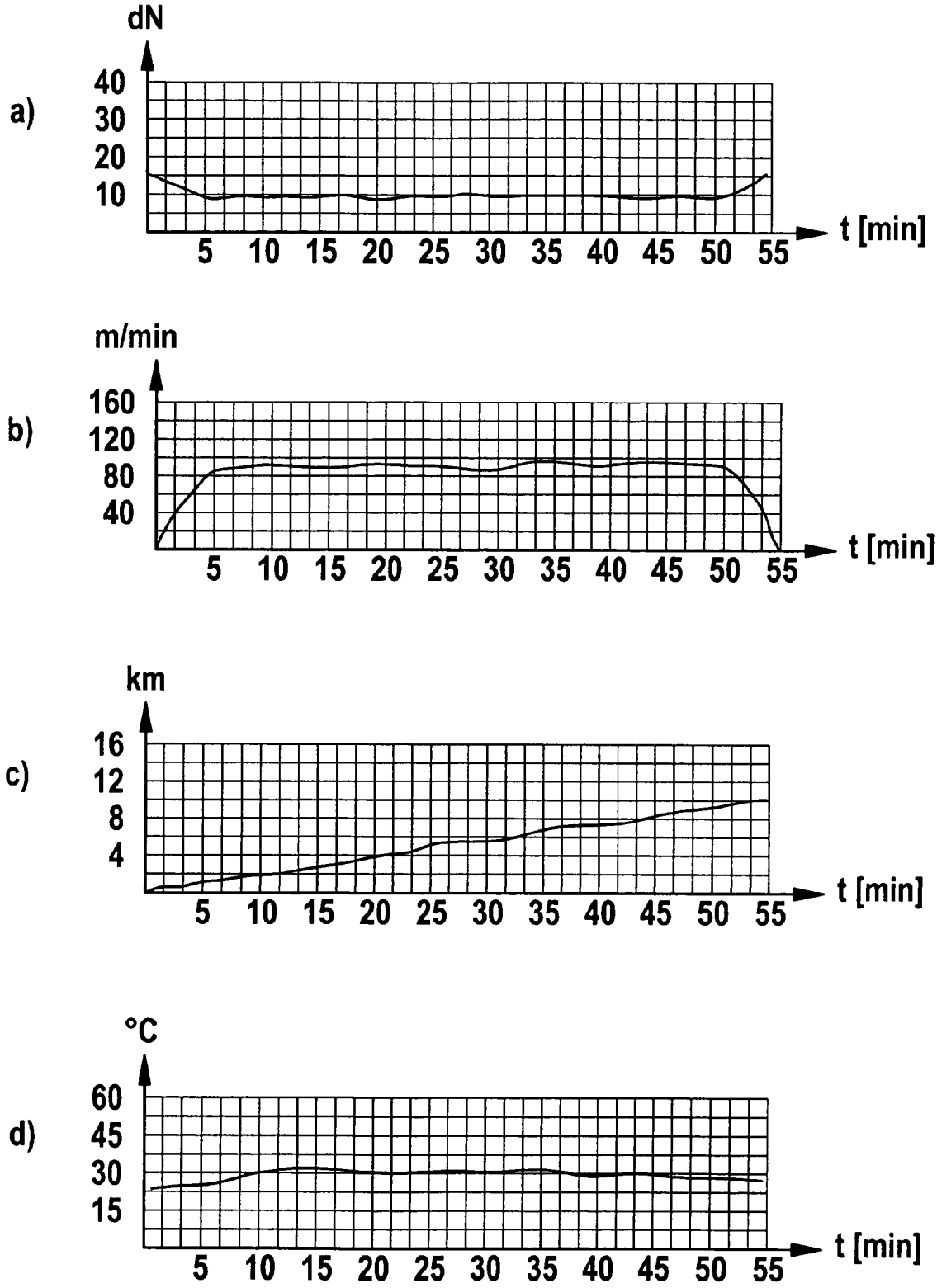
FIG. 6 shows a measurement log for the dependence, in each case on time, of the drawing-on force (a), drawing-on speed (b), total meters (c) and temperature (d) in use of one apparatus according to the invention.

FIG. 6 shows a measurement log wherein, as data ascertained during drawing-on, there are shown the drawing-on force in dN (a), the drawing-on speed in m/min (b), the total meters in km (c) and the temperature in ° C. (d), in each case over time t. Alternate embodiments of the invention may display the total meters in m. Besides being shown on the visual display unit 39*a*, it is possible to output the measurement log, for example by means of a printer (not shown) or the like, which is connected to the electronic control and regulation device 26.

Figure 7A:
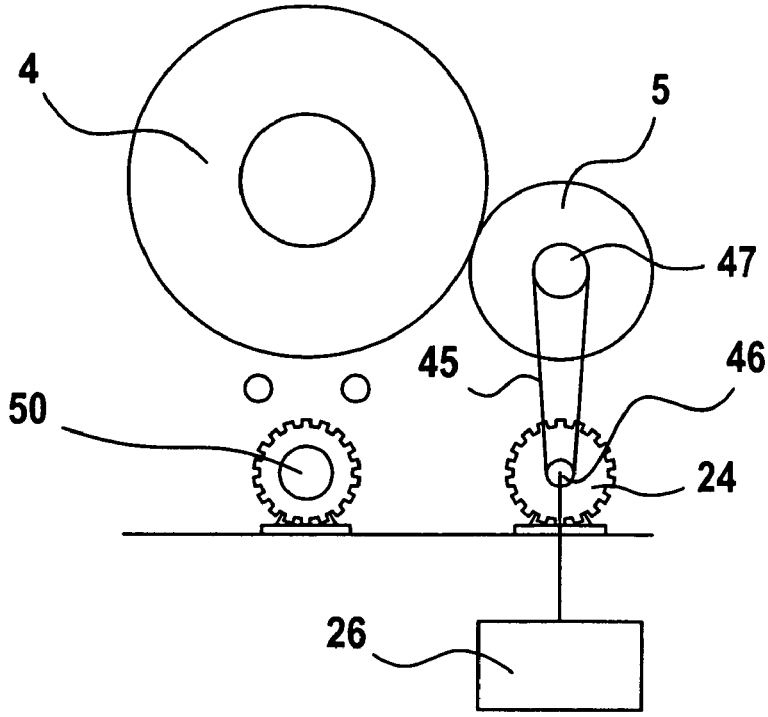
FIG. 7*a* shows a speed-controlled drive motor for the doffer during production by the doffer of the flat card according to FIG. 1.
Figure 7B:
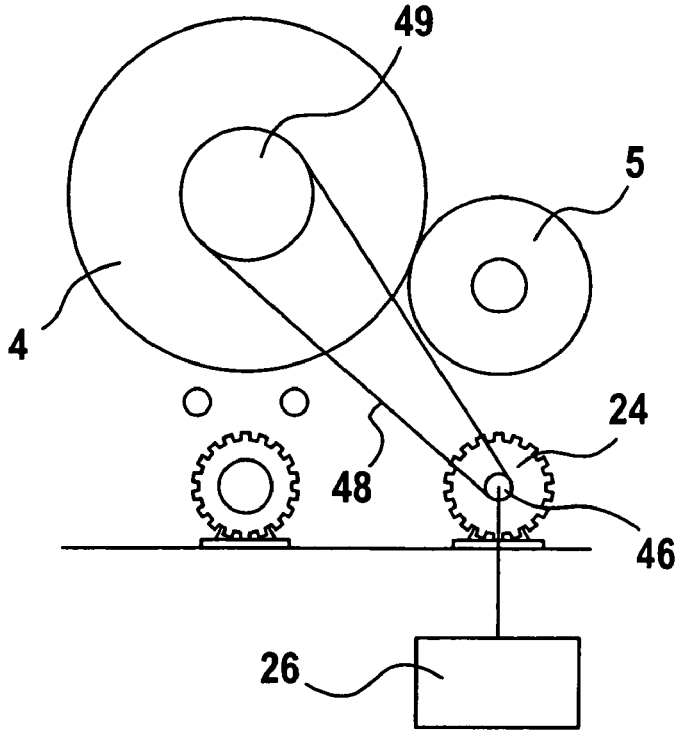
FIG. 7*b* shows a second arrangement of a winding-on and winding-off apparatus comprising the speed-controlled drive motor for the doffer according to FIG. 7*a* during clothing of the cylinder.

In accordance with FIGS. 7*a*, 7*b*, the speed-controlled motor 24 is associated with the doffer 5. During production by the carding machine, the motor 24 drives the doffer 5 by way of the belt 45 (see FIG. 7*a*). The belt 45 loops around the belt pulleys 46 and 47. During clothing of the cylinder 4, the motor 24 drives the cylinder 4 by means of another belt 48 (see FIG. 7*b*). The belt 48 loops around the belt pulleys 46 and 49.

By that means, a motor already present in the machine and equipped with speed control is used for driving the rollers during the clothing process at the customer's premises. That motor can be a motor which is in any case present for the production region of the roller (4 or 5) in question. However, it is also possible, in accordance with FIGS. 7*a*, 7*b*, for, for example, the doffer motor 24, which is provided as standard with highly accurate speed control, to be used for clothing of the cylinder 4. For that purpose it is merely necessary to remove the drive belts between the doffer motor 24 and the doffer 5 and between the cylinder motor 50 and the cylinder 4 and to fit a belt 48 or the like between the doffer motor 24 and the cylinder 4 (FIG. 7*b*). The machine is so constructed mechanically that a transmission of such a kind is possible and corresponding belt pulleys of the correct size and kind are already present. By that means it is possible, very simply, rapidly and with only minimal outlay, to produce the drive for clothing of the rollers.

Although the foregoing invention has been described in detail by way of illustration and example for purposes of understanding, it will be obvious that changes and modifications may be practised within the scope of the appended claims.

What is claimed is:

1. A drawing-on apparatus for drawing a clothing onto a roller of a spinning room machine, the spinning room machine including an electronic control and regulation device operable to control a spinning operation of the spinning room machine, the drawing-on apparatus comprising:

a measuring device to measure data relating to drawing of the clothing onto the roller, wherein the measuring device is arranged to co-operate, in use, with the control and regulation device to permit passage of data between the drawing-on apparatus and the control and regulation device.

2. The apparatus according to claim 1, wherein the data is transferable unidirectionally between the drawing-on apparatus and the control and regulation device.

3. The apparatus according to claim 1, wherein the data is transferable bidirectionally between the drawing-on apparatus and the control and regulation device.

4. The apparatus according to claim 1, wherein communication between the control and regulation device and the measuring device is cable-based.

5. The apparatus according to claim 1, wherein communication between the control and regulation device and the measuring device ascertaining the drawing-on data comprises wireless communication.

6. The apparatus according to claim 5, wherein said wireless communication includes radio, infra-red light, or visible light.

7. The apparatus according to claim 1, further comprising a roller drive unit, wherein the roller drive unit includes a drive motor.

8. The apparatus according to claim 1, further comprising a braking device to act on the clothing for producing winding-on pretensioning in a region of the clothing between the roller and braking device.

9. The apparatus according to claim 8, wherein the braking device comprises a braking force sensor and/or a speed sensor.

10. The apparatus according to claim 1, wherein the data include one or more data including drawing-on force; drawing-on speed; temperatures of braking elements of a braking device of the drawing-on apparatus; a length of the clothing drawn on; and a braking force.

11. The apparatus according to claim 1, wherein the drawing-on of the clothing is logable.

12. The apparatus according to claim 1, wherein tension of the drawing-on is recordable.

13. The apparatus according to claim 1, wherein the measuring device records stretching that is present in the clothing is recorded.

14. A spinning room machine comprising:

a roller;

a control and regulation device to control a spinning operation of the spinning room machine; and a drawing-on apparatus to draw a clothing onto the roller, wherein the drawing-on apparatus comprises:

a measuring device to measure data relating to drawings of the clothing onto the roller, wherein the measuring device is arranged to co-operate, in use, with the control and regulation device to permit passage of data between the measuring device and the control and regulation device.

15. The spinning preparation machine according to claim 14, wherein the electronic control and regulation device comprises a storage device for storing the ascertained data.

16. The spinning preparation machine according to claim 14, further comprising an operating and display device, wherein the operating and display device displays the data ascertained during the drawing of the clothing onto the roller, the data being transferred to and stored at the spinning room machine.

17. The spinning preparation machine according to claim 14, wherein the control and regulation device at least partially controls operation of the measuring device.

18. The spinning room machine according to claim 14, further comprising a display device for showing or visualizing the data, the display device being coupled to the electronic control and regulation device.

19. The spinning room machine according to claim 14, wherein the control and regulation device and the measuring device compare and/or link the data ascertained during drawing of the clothing onto the roller with data of the spinning operation of the spinning room machine.

20. The spinning room machine according to claim 14, wherein the control and regulation device includes a control and regulation circuit, the circuit including a roller drive unit, wherein the control and regulation unit controls and/or regulates the roller drive unit for automatic matching to predetermined winding-on tensioning values.

21. The spinning room machine according to claim 14, wherein the roller comprises a cylinder or a doffer of a flat card.

22. The spinning room machine according to claim 14, wherein the drawing-on apparatus further comprises a second control and regulation device and a braking device, wherein the second control and regulation device is integrated into the braking device, wherein braking action is automatically matchable to the winding-on pretensioning values.

* * * * *